US007794549B2

(12) United States Patent
Welch et al.

(10) Patent No.: US 7,794,549 B2
(45) Date of Patent: Sep. 14, 2010

(54) DRIP SHIELD FOR A DRAWER-TYPE DISHWASHER

(75) Inventors: Rodney M. Welch, Beach Bluff, TN (US); Thomas J. Wuestefeld, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/694,309

(22) Filed: Jan. 27, 2010

(65) Prior Publication Data

US 2010/0126530 A1 May 27, 2010

Related U.S. Application Data

(62) Division of application No. 11/407,117, filed on Apr. 20, 2006, now Pat. No. 7,678,202.

(51) Int. Cl.
*B08B 9/20* (2006.01)

(52) U.S. Cl. ..... 134/25.2; 134/25.1

(58) Field of Classification Search ..... None
See application file for complete search history.

(56) References Cited

FOREIGN PATENT DOCUMENTS

EP 1316285 * 6/2003

* cited by examiner

*Primary Examiner*—Michael Kornakov
*Assistant Examiner*—Ryan Coleman
(74) *Attorney, Agent, or Firm*—John W. Morrison; Diederiks & Whitelaw PLC

(57) ABSTRACT

A drip shield is mounted to a drawer of a drawer-type dishwasher so as to extend along an outer rear surface of the drawer and catch droplets of washing fluid falling from a lid of the dishwasher. The drip shield includes a shelf that extends between up-turned wall portions. The shelf is angled away from the tub so that any droplets of washing fluid that may fall onto the drip shield will migrate away from the drawer. The shelf is also formed such that first and second end portions are positioned higher than a central or intermediate portion. This construction forces the droplets of washing fluid to collect in a centralized drain point from where the droplets of water can be guided to a controlled location.

9 Claims, 4 Drawing Sheets

DRIP SHIELD FOR A DRAWER-TYPE DISHWASHER

CROSS REFERENCE TO RELATED APPLICATIONS

The present application is a division of U.S. application Ser. No. 11/407,117, filed Apr. 20, 2006, currently allowed.

BACKGROUND OF THE INVENTION

1. Field of the Invention

The present invention pertains to the art of dishwashers and, more particularly, to a drip shield for a drawer-type dishwasher that prevents water from falling from a lid assembly onto wash system components.

2. Discussion of the Prior Art

In general, drawer-type dishwashers are known in the art. Typically, a drawer-type dishwasher will include a drawer or washing tub slidably mounted in a cabinet. A dish rack is provided within the washing tub to support dishware and the like during a washing operation. There are various models of drawer-type dishwasher available to consumers. Dishwashers can range from a single unit, to multi-compartment units that are arranged in upper and lower or side-by-side configurations. However, regardless of the particular configuration, drawer-type dishwashers include a lid that selectively seals the washing tub during the washing operation.

During the washing operation washing fluid is sprayed onto dishware and the like situated in the washing tub. Ultimately, droplets of washing fluid accumulate on the lid. At the completion of the washing operation, the drawer is withdrawn from the cabinet, allowing removal of the now clean dishware. However, as the drawer is withdrawn, droplets of washing fluid fall from the lid onto uncontrolled locations in the cabinet. Eventually, the washing fluid can cause damage to internal machine components and may cause erosion to the cabinet itself.

In order to prevent the droplets of water from falling uncontrollably into the cabinet, manufacturers have developed a variety of mechanisms to either remove the water or guide the droplets to a more appropriate location. The mechanisms range from angling the lid so as to guide the droplets to a predetermined location, or providing a blower that directs jets of air across an underside of the lid, causing the droplets to quickly evaporate.

Regardless of the mechanisms employed, there still exists a need for a mechanism that prevents droplets of washing fluid from falling onto uncontrolled locations of a drawer-type dishwasher. More specifically, there exists a need for a drip shield that is mounted to a washing tub of a drawer-type dishwasher to collects and guide droplets of washing fluid away from internal machine components.

SUMMARY OF THE INVENTION

The present invention is directed to a drip shield for a drawer-type dishwasher that includes an outer support body and a drawer slidably supported in the outer support body. The drawer preferably includes front, rear, opposing side and bottom walls that collectively define a washing chamber. A wash arm is positioned in the wash chamber to deliver sprays of washing fluid, delivered from wash system components, onto objects during a washing operation. The dishwasher also includes a lid assembly that is mounted to the outer support body and selectively seals the washing chamber during the washing operation.

In accordance with the invention, the drip shield is mounted to the drawer along an outer surface of the rear wall. Preferably, the drip shield is mounted at a lower portion of the rear wall. In any event, the drip shield includes a shelf that extends between first and second up-turned wall portions. The shelf is angled away from the washing chamber ensuring that any droplets of washing fluid that may fall onto the drip shield will migrate away from the drawer. The shelf is also formed such that first and second end portions are higher than a central or intermediate portion. This configuration forces the droplets of washing fluid to collect at a centralized drain point. An opening is formed in the central portion of the shelf to establish the drain point, thereby allowing the droplets of water to be guided from the shelf to a controlled location in the outer support body.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
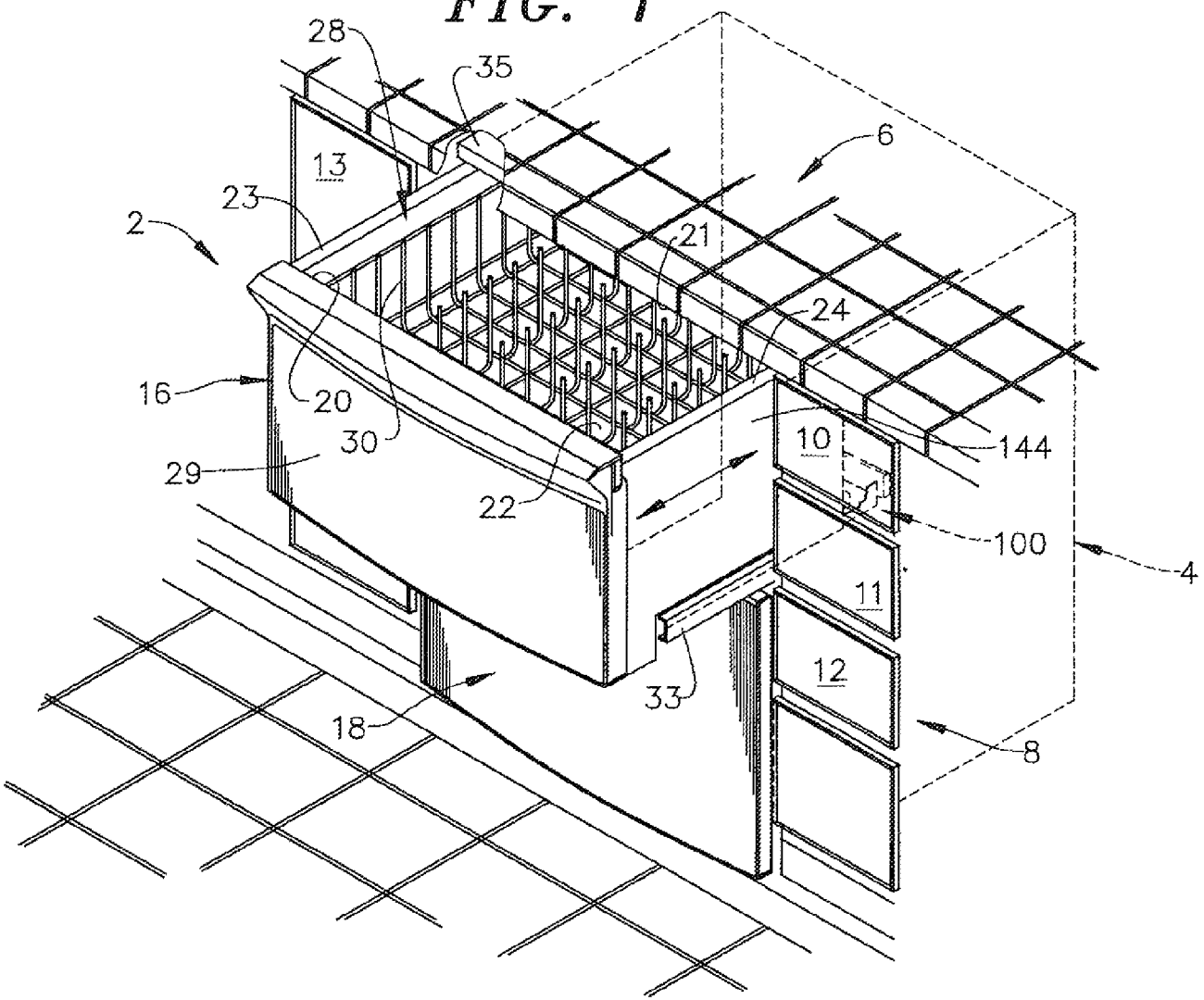
FIG. 1 is an upper right perspective view of a drawer-type dishwasher incorporating a drip shield constructed in accordance with the present invention.

With initial reference to FIG. 1, a dishwasher constructed in accordance with the present invention is generally indicated at 2. As shown, dishwasher 2 includes an outer support body 4 arranged below a kitchen countertop 6. Also illustrated below kitchen countertop 6 is cabinetry 8 including a plurality of drawers 10-12, as well as a cabinet door 13. Although the actual dishwasher into which the present invention may be incorporated can vary, the invention is shown in connection with drawer-type dishwasher 2 depicted as a dual cavity dishwasher having an upper washing unit 16 and a lower washing unit 18.

In accordance with the invention, upper washing unit or drawer 16 is shown to include a front wall 20, rear wall 21, bottom wall 22 and opposing side walls 23 and 24 that collectively define an upper washing chamber 28. In addition, drawer 16 is provided with a decorative façade 29 that is secured to front wall 20. In a manner known in the art, upper washing chamber 28 is provided with a wire dish rack 30 for supporting various objects, such as dishware, glassware, and the like, to be exposed to a washing operation. Also in a manner known in the art, drawer 16 is slidably supported within outer support body 4 through a pair of drawer support guides, one of which is indicated at 33. Each drawer 16, 18 is provided with a corresponding lid assembly, one of which is indicated at 35 for drawer 16, for sealing washing chamber 28.

Figure 2:
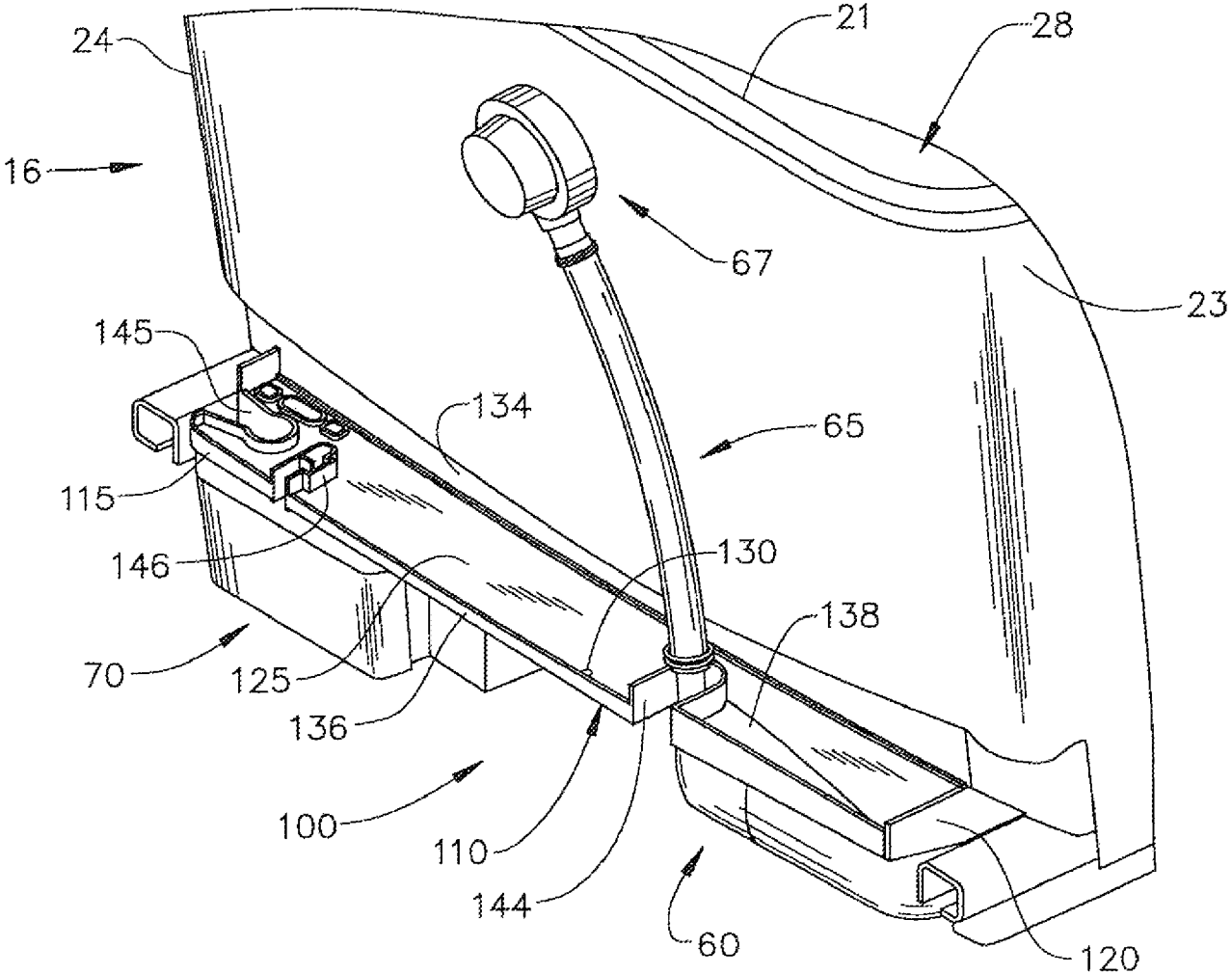
FIG. 2 is a partial rear view of a washing tub portion of the drawer-type dishwasher of FIG. 1, illustrating the drip shield mounted in accordance with the present invention.

Drawer 16 includes a plurality of wash system components that establish the washing operation in washing chamber 28. More specifically, as best shown in FIG. 2, a wash pump 60 is mounted to an underside of drawer 16. Wash pump 60 includes a water supply line 65 that extends along an outer surface of rear wall 21 prior to terminating in an outlet 67. Outlet 67 leads into washing chamber 28 so that washing fluid, emanating from wash pump 60, enters into washing chamber 28 to impinge upon items contained therein during a washing operation. At the completion of the washing operation or, periodically during the washing operation, washing fluid is drained from washing chamber 28 through operation of a drain pump 70 which is also shown mounted to an underside of upper washing unit 16. In any event, during the washing operation, droplets of water/washing fluid accumulate on underside of lid assembly 35. If left unchecked, the droplets of water could eventually fall onto various wash system components.

In accordance with the invention, in order to prevent droplets of water from falling onto wash system components within outer support body 4 from lid assembly 35, a drip shield 100 is mounted to drawer 16. Preferably, drip shield 100 is mounted to a lower, rear portion of washing unit 16 just above wash pump 60 and drain pump 70. As best shown in FIGS. 2-5, drip shield 100 preferably includes a main body portion 110 having first and second end portions 115 and 120 that are separated by an intermediate or shelf portion 125. Shelf portion 125 is preferably angled downward away from washing chamber 28. Moreover, shelf portion 125 is preferably lower than first and second end portions 115 and 120 establishing an overall concave profile such that any droplets of water accumulating on drip shield 100 will migrate towards a lowermost drain or opening 130 and thereafter be guided to a controlled location in outer support body 4.

In order to contain the droplets of water on shelf portion 125, drip shield 100 includes a first rib 134 that extends along an outer surface of rear wall 21, between first and second end portions 115 and 120, and a second, opposing rib 136 that is substantially parallel to and spaced from first rib 134. In addition, drip shield 100 includes a guide portion 138 positioned adjacent second end portion 120 which, as will be discussed more fully below, directs droplets of washing fluid towards drain 130.

Figure 3:
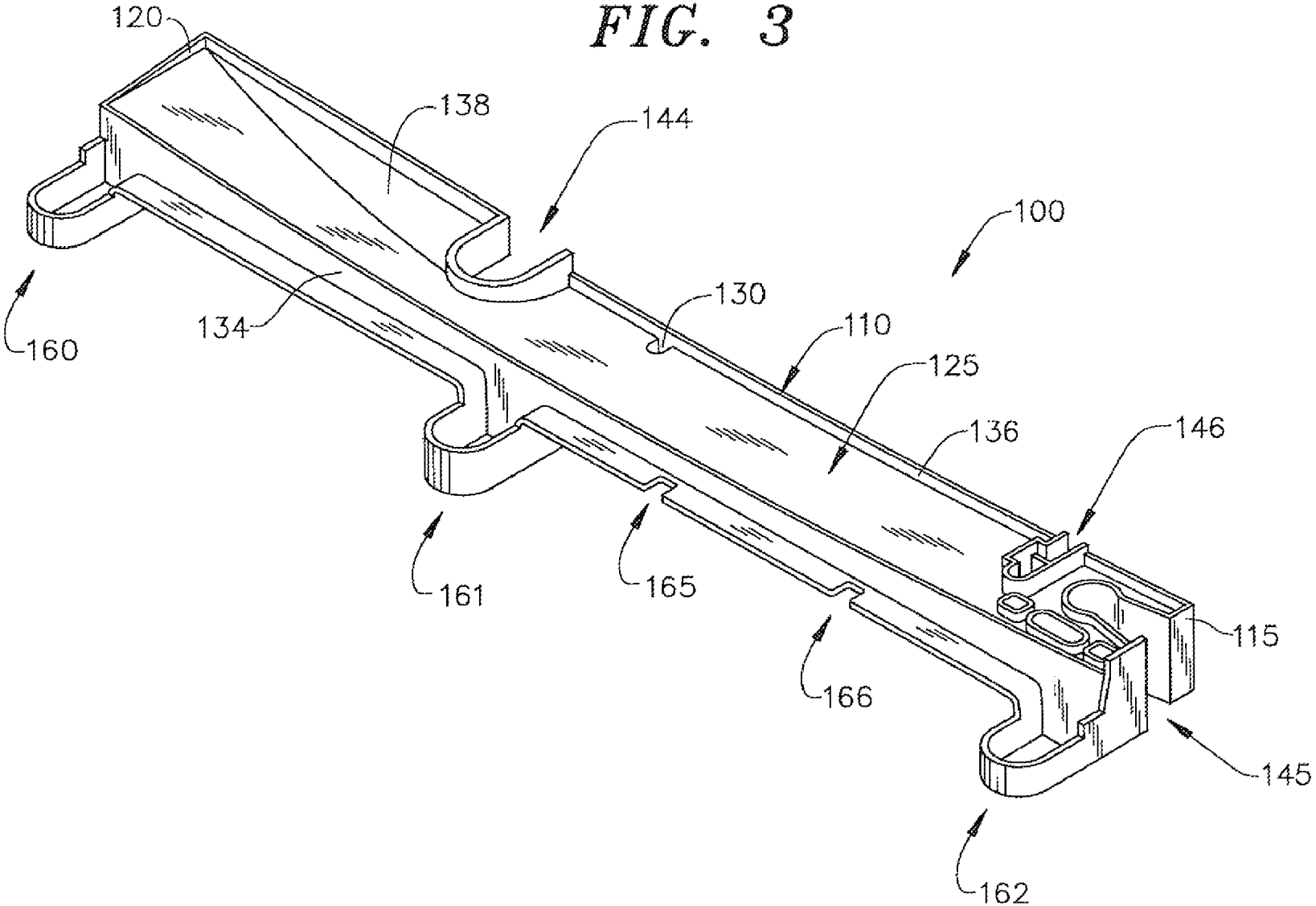
FIG. 3 is a perspective view of the drip shield of FIG. 2.
Figure 4:
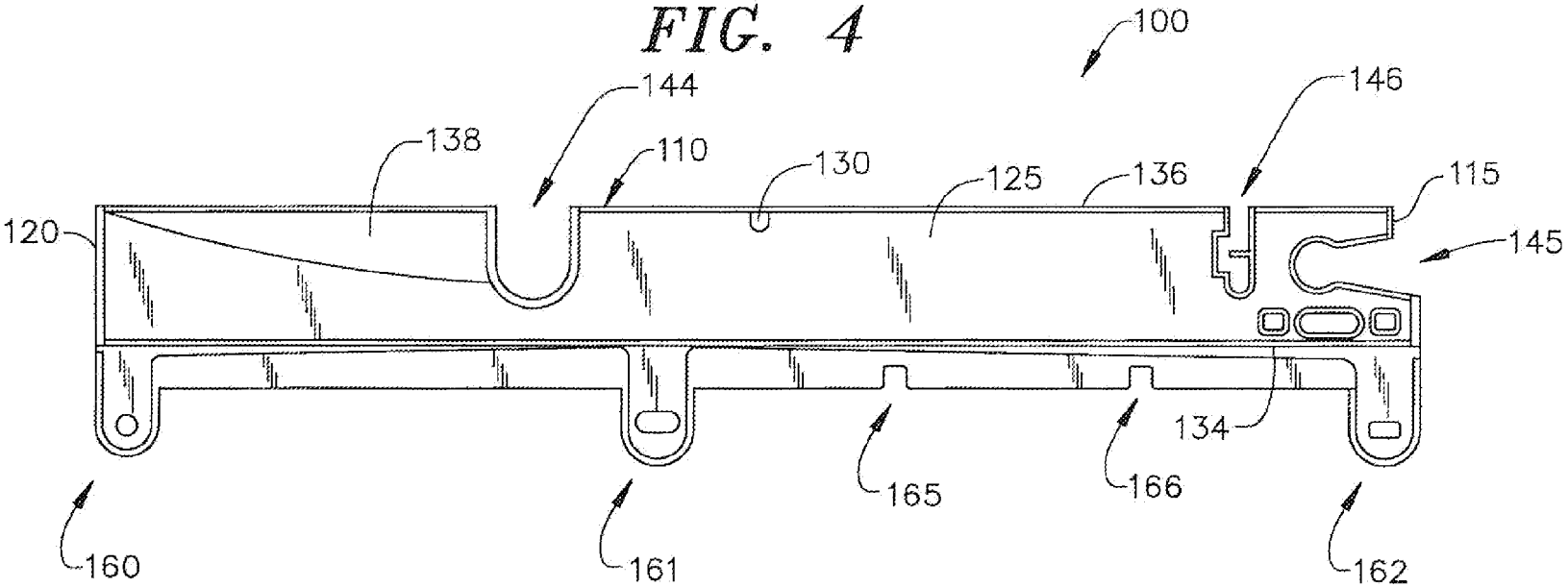
FIG. 4 is a top, plan view of the drip shield of FIG. 3.
Figure 5:
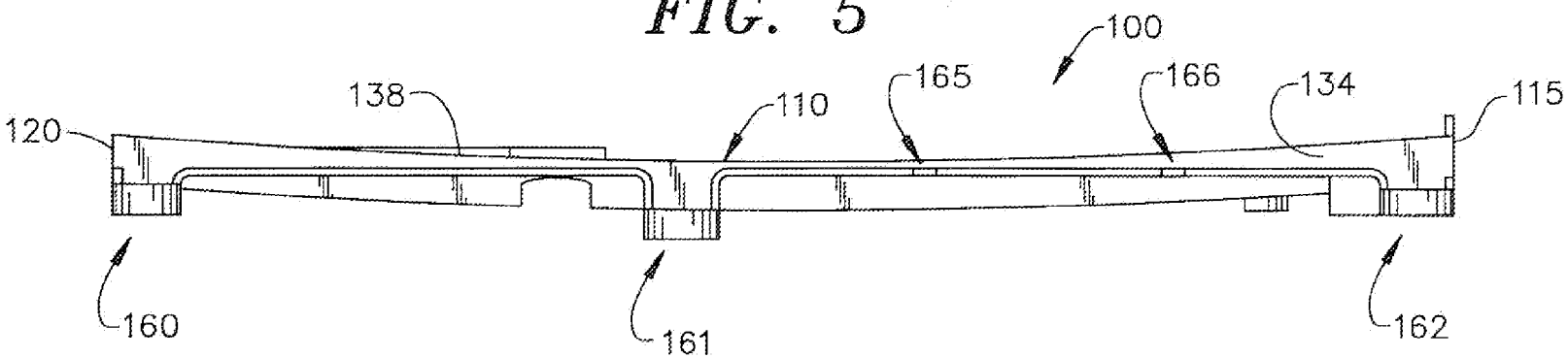
FIG. 5 is a front elevational view of the drip shield of FIG. 3.

In accordance with the most preferred form of the invention, drip shield 100 includes a plurality of mounting zones 144-146 which support various conduits that interconnect the wash system components with tub 28 and household utilities. More specifically, mounting zone 144 provides a path for water supply 65 to pass through drip shield 100. Mounting zone 145 provides an opening that allows a drain line to pass from drain pump 70 and thereafter interconnect with a household drain. Finally, mounting zone 146 provides support for an electrical connection (not shown) which serves to connect the various wash system components with a main control module or control board (not shown). In addition to mounting zones 144-146, drip shield 100 includes a plurality of mounting lugs 160-162 that project outward from wall portion 135. As best shown in FIGS. 3 and 4, mounting lugs 160-162 serve as an interface between drip shield 100 and drawer 16. Each mounting lug 160-162 includes an aperture (not shown) that receives a mechanical fastener (also not shown) for joining drip shield 100 to an underside of drawer 16. Finally, drip shield 100 is shown to include a pair of clearance notches 165 and 166 which accommodate structure molded onto an underside of drawer 26.

At this point, it should be understood that drip shield 100 constructed in accordance with the present invention provides structure for catching droplets of washing fluid dripping from lid assembly 35 and guiding the droplets of washing fluid to a controlled location within wash unit 16 and/or 18. Drip shield 100 also serves to protect the various wash system parts and components from being affected by droplets of water falling uncontrolled into dishwasher 2. The drip shield can be attached to the drawer in various ways, including forming the drip shield separate from the drawer and securing to the drawer or integrally molding the drip shield with the drawer. In any case, although described with reference to a preferred embodiment of the invention, it should be readily understood that various changes and/or modifications can be made to the invention without departing from the spirit thereof. For instance, the type and number of mounting zones, as well as the type and number of mounting lugs, can be readily varied. In addition, it should be realized that, although capturing the droplets in accordance with the most preferred embodiment constitutes directing the droplets from the shelf portion to the drain, the capturing function could be performed by deflecting the droplets in a desired direction, particularly away from the wash system components. In general, the invention is only intended to be limited by the scope of the following claims.

We claim:

1. A method of operating a dishwasher comprising:

shifting a drawer, having front, rear, bottom, and opposing side walls that collectively define a washing chamber, into an outer support body;

sealing a lid assembly over the washing chamber;

activating at least one wash system component to perform a washing operation in the washing chamber which causes droplets of washing fluid to collect on the lid assembly;

shifting the drawer out from the outer support body;

catching at least some of the droplets of washing fluid falling from the lid assembly on a drip shield which is attached to and extends beyond the rear wall of the drawer and includes a drain; and removing washing liquid caught by the drip shield through the drain.

2. The method of claim 1, further comprising:

guiding the droplets of washing fluid to a drain formed in a central portion of the drip shield; and directing the droplets of washing fluid from the drain to a predetermined area of the dishwasher.

3. The method of claim 2, wherein the droplets of water are directed along a concave surface of the drip shield towards the drain.

4. The method of claim 1, further comprising: attaching the drip shield to the bottom wall of the drawer.

5. The method of claim 1, further comprising: routing at least one conduit for the at least one wash system component through a mounting zone formed in the drip shield.

6. A method of operating a dishwasher including: an outer support body; a drawer slidably supported for movement into and out of the outer support body, said drawer including front, rear, opposing side and bottom walls that collectively define a washing chamber; at least one wash system component arranged within the outer support body; a lid assembly mounted to the outer support body; and a drip shield including a main body portion having first and second laterally opposed end portions separated by a central shelf portion, said drip shield being attached to and extending beyond a lower portion of the rear wall, said method comprising:

sealing the washing chamber with the lid assembly for a washing operation;

generating a flow of washing fluid through the washing chamber by operation of said at least one wash system component during the washing operation; and catching, by the drip shield, washing fluid which drops from the lid assembly when the drawer is shifted from within the outer support body following the washing operation.

7. The method of claim 6, further comprising: removing washing fluid caught by the drip shield through a drain provided in the drip shield.

8. The method of claim 7, further comprising: directing droplets of washing fluid to flow from the first and second end portions to a generally concave portion of the central shelf portion towards the drain.

9. The method of claim 7, further comprising: guiding droplets of washing fluid around a plurality of mounting zones formed in the main body portion for supporting at least one of a fluid and an electrical conduit and towards the drain.

* * * * *